United States Patent [19]

Cyvas

[11] 4,190,089

[45] Feb. 26, 1980

[54] PROJECTILE LAUNCHING APPARATUS

[75] Inventor: Petras Cyvas, Worcester, Mass.

[73] Assignee: Crompton & Knowles Corporation, New York, N.Y.

[21] Appl. No.: 2,642

[22] Filed: Jan. 11, 1979

[51] Int. Cl.[2] ..... D03D 47/36

[52] U.S. Cl. ..... 139/437; 139/452

[58] Field of Search ..... 139/437, 438, 439, 450, 139/452, 196.2, 196.3

[56] References Cited

U.S. PATENT DOCUMENTS

| | | | |
|---|---|---|---|
| 3,831,640 | 8/1974 | Wueger | 139/196.3 |
| 3,868,976 | 3/1975 | Wueger | 139/437 |
| 3,902,530 | 9/1975 | Wueger | 139/437 |
| 4,046,174 | 9/1977 | Wueger | 139/437 |

*Primary Examiner*—Henry Jaudon

[57] ABSTRACT

A projectile launching and receiving apparatus for a pneumatic loom which includes a bore for receiving the projectile, a pneumatic launching chamber connected to the bore which is pressurized for launching the projectile, a passageway for guiding filling yarn from an outer opening to the bore, and valve means for blocking the passageway between the opening and pressure chamber to prevent filling yarn from being blown toward the outer opening.

9 Claims, 7 Drawing Figures

PROJECTILE LAUNCHING APPARATUS

BACKGROUND OF THE INVENTION

This invention relates generally to outside filling supply looms in which a small projectile is utilized to carry the filling yarn to the warp shed from supply packages located outside of the loom. The present invention is particularly directed to looms of the type in which filling yarn is inserted alternately from each side of the loom such as in the loom disclosed in U.S. Pat. No. 3,831,640 to Karl W. Wueger issued Aug. 27, 1974. In this loom, a projectile is launched from a launching and receiving apparatus at one side of the loom to a launching and receiving apparatus at the opposite side of the loom. Each launching and receiving apparatus contains a bore for receiving the projectile, a pressure chamber connected to the bore and a passageway leading from the bore to an outside opening. Filling yarn from an outside supply package enters the outside opening and extends to the bore through the passageway. Means is provided for inserting at least a portion of a filling pick into the projectile and pressurizing the pressure chamber to launch the projectile through the warp shed. Although most of the pressurized air escapes through the bore behind the launched projectile, a certain amount of "back pressure" extends through the passageway toward the outlet opening. This "back pressure" causes filling yarn to be blown toward the outer opening. Pressure is also created in the passageway when the projectile is received from the opposite side of the loom. As the incoming projectile is received into the bore, there is a pressure build-up which causes an air flow in the passageway toward the outer opening. At this point in the weaving cycle, the free end of the filling yarn is precisely positioned adjacent the bore in readiness for insertion into the projectile. The air flow caused by the incoming projectile causes this free end to be displaced, thereby seriously affecting the subsequent projectile loading step. This air flow may also cause the filling to be blown out of the outer opening which would necessitate stopping the loom for reinsertion of the filling yarn into the launching and receiving apparatus. These and other difficulties experienced with the prior art devices have been obviated by the present invention.

It is, therefore, a principal object of the present invention to provide a projectile launching and receiving apparatus for a pneumatic loom in which the effects of "back pressure" are obviated during the launching and receiving phases of a weft inserting cycle.

Another object of the invention is the provision of a valve which is effective to block the yarn passageway in the projectile launching and receiving apparatus to prevent air flow toward the outer opening of the apparatus.

A further object of the present invention is the provision of a valve closure element movable into the yarn passageway of a projectile launching and receiving apparatus which does not damage the yarn or otherwise interfere with normal feed of the yarn within the passageway.

With these and other objects in view, as will be apparent to those skilled in the art, the invention resides in the combination of parts set forth in the specification and covered by the claims appended hereto.

SUMMARY OF THE INVENTION

In general, the invention consists of a projectile launching and receiving apparatus for a pneumatic loom in which filling picks are inserted from an outside supply source. The projectile launching and receiving apparatus is provided with a housing having an inner opening which leads into a projectile receiving bore at one end of the housing, an outer opening at the opposite end of the housing, a pressure chamber connected to the bore for launching the projectile, and an elongated passageway extending from the outer opening to the bore for guiding filling yarn from the outer opening to the projectile receiving bore. Valve means is provided which includes a valve element movable from an open position, in which the element is clear of the passageway to a closed position in which the element is effective to seal the passageway. The valve element is moved in timed relation with the loom by a control means, so that it is in closed position during the launching and receiving of the projectile. The valve is effective in the closed position to prevent air flow in the passageway toward the outer opening during the receiving and launching of the projectile. More specifically, the valve includes a rod with an elastomeric tip slidable in a valve bore extending at an angle to and intersecting with the yarn passageway within the housing. Means is also provided for adjustably positioning the valve element within the elongated valve bore.

BRIEF DESCRIPTION OF THE DRAWINGS

The character of the invention, however, may be best understood by reference to one of its structural forms, as illustrated by the accompany drawings, in which.

DESCRIPTION OF THE PREFERRED EMBODIMENT

Figure 1:
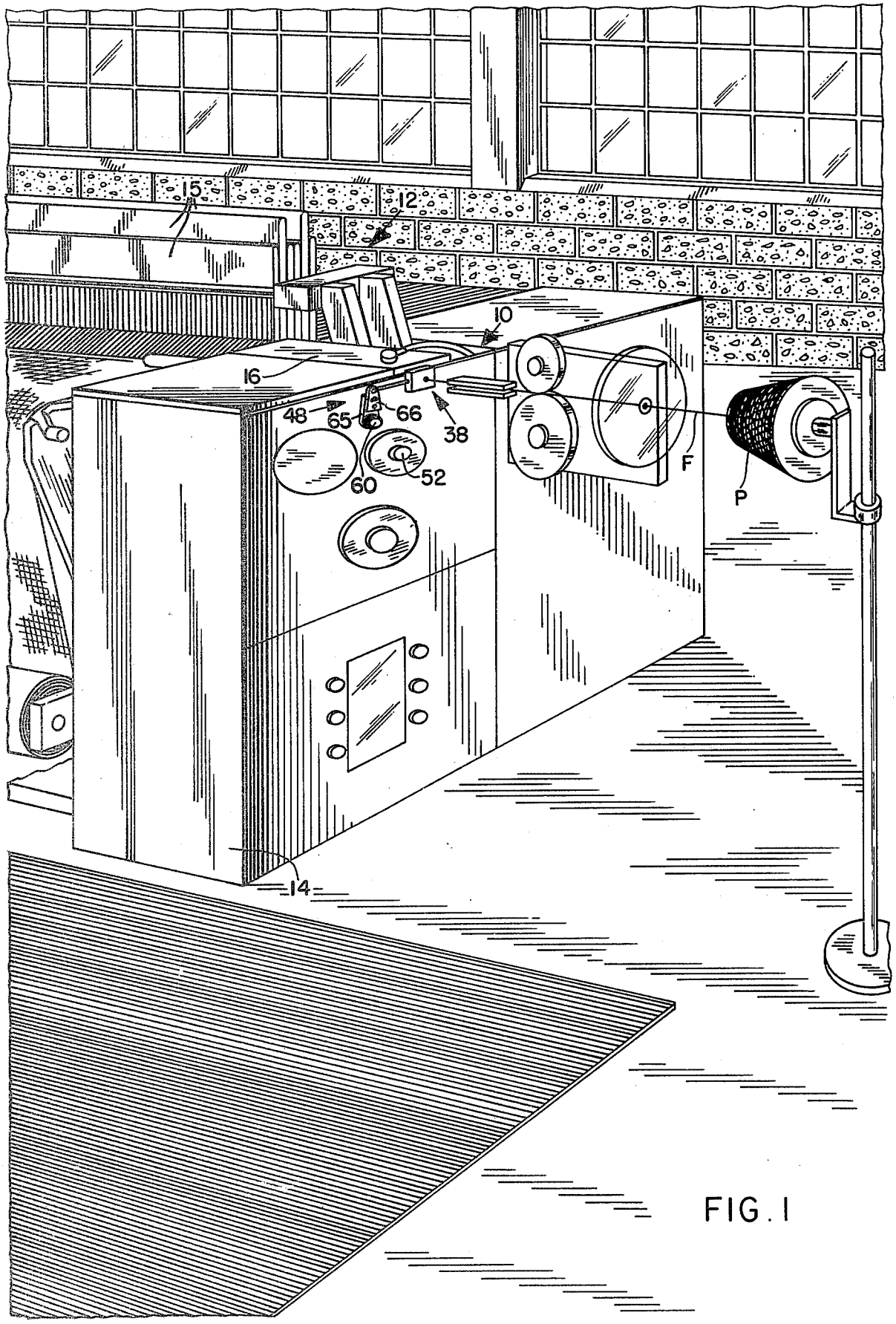
FIG. 1 is a perspective view of one end of a pneumatic loom incorporating the present invention.

Referring particularly to FIG. 1, there is shown a projectile launching and receiving apparatus, generally indicated by the reference 10, applied to the right-hand side of a pneumatic outside filling supply loom, generally indicated by the reference numeral 12. The left-hand side of the loom is provided with an identical launching and receiving apparatus but of opposite hand. Loom 12 includes all of the weaving instrumentalities of the loom shown in U.S. Pat. No. 3,831,640, supra, including framework 14 and heddle frames 15 for forming the warp shed. The filling yarn indicated at F is drawn from a supply package P located outside of the loom frame.

Figure 3:
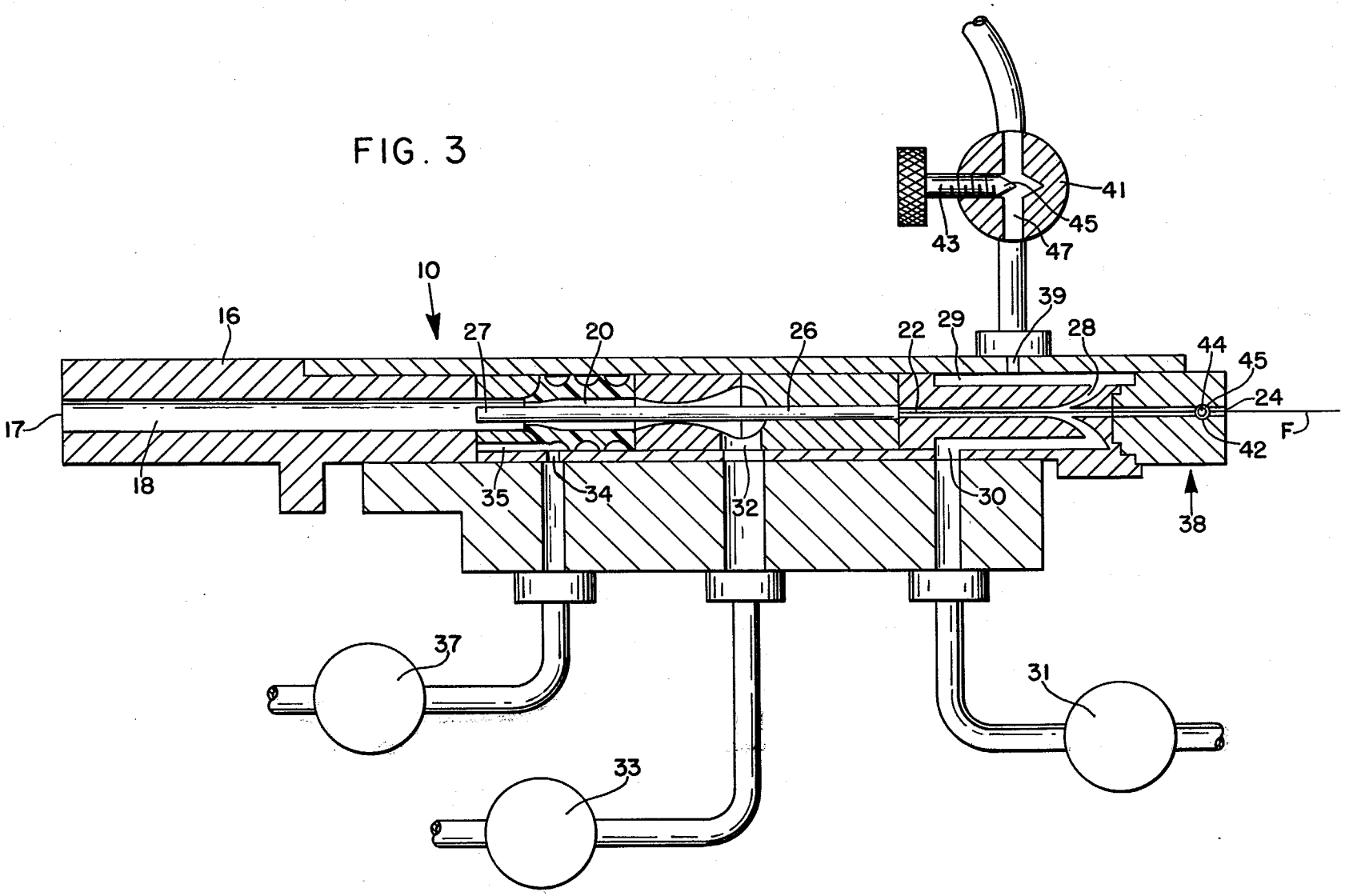
FIG. 3 is a vertical sectional view of the launching and receiving apparatus taken on the line III—III of FIG. 2.

Referring particularly to FIG. 3, the projectile launching and receiving apparatus 10, comprises a housing 16 having an inner opening 17 which forms the entrance to a projectile receiving bore 18. A pressure chamber 20 is located within the central portion of the housing and is connected to bore 18. A passageway 22 extends from the bore 18 to an outer opening 24 located at the opposite end of the housing from inner opening 17. A portion of passageway 22 includes a tube 26 which extends through to the pressure chamber 20 and into the bore 18. Filling yarn extends from the supply package P through opening 24 and along passageway 22, including tube 26, to the end portion 27 of the tube which extends into bore 18. The filling projectile (not shown) but similar to that shown in the Wueger patent, supra is located in bore 18 prior to launching. The projectile includes a storage chamber and an opening leading from the storage chamber to the end of the projectile. When the projectile is positioned within the bore 18, the portion 27 of tube 26 extends into the storage chamber of the projectile. Filling yarn is introduced into the storage chamber by means of a blast of air from jet 28 which extend into the passageway 22. The air is directed to the jet 28 from an annular chamber 29. Air is introduced into chamber 29 through a port 30 connected to a pressure source (not shown) through a valve 31. After filling yarn has been loaded into the projectile chamber, high pressure air is directed into pressure chamber 20 from a port 32. Air is introduced into port 32 from a high pressure source (not shown) through a valve 33. Housing 16 also includes a port 34 through which pressurized air is introduced and conveyed by means of a channel 35 to air brakes surrounding bore 18. A valve 37 controls the flow of air into port 34. The air brakes are not shown but disclosed in the Wueger patent, supra. When the air brakes are pressurized, they act to stop the incoming projectile which has been launched from the opposite side of the loom.

A second port 39 connects chamber 29 to a source of high pressure air (not shown) through a needle valve 41. Although valve 41 is connected to a source of higher air pressure than valve 31, the flow of air from valve 41 to port 39 is restricted by the valve so that the air pressure in port 39 is low. Valve 41 is provided with an adjusting screw 43 including a tip 45 which extends into the passageway 47 of the valve to restrict the flow of air through the valve. After the projectile reaches the opposite side of the loom, the filling yarn is clamped and severed. The severed end is retracted to a precise location in tube 26 by means not shown. Valve 41 remains open, so that there is a constant flow of low pressure air through the jet 28 into passageway 22 to maintain the filling yarn fully extended in the passageway in readiness for a subsequent projectile loading sequence. This function is particularly useful during retraction of the filling. Although valve 41 provides chamber 29 with a low pressure air flow, the introduction of high pressure air in chamber 29 from port 30 upon opening of valve 31 will not affect the elements associated with port 39 since valve 41 is connected to a source of air pressure which is higher than that of the source which is connected to valve 31.

Figure 5:
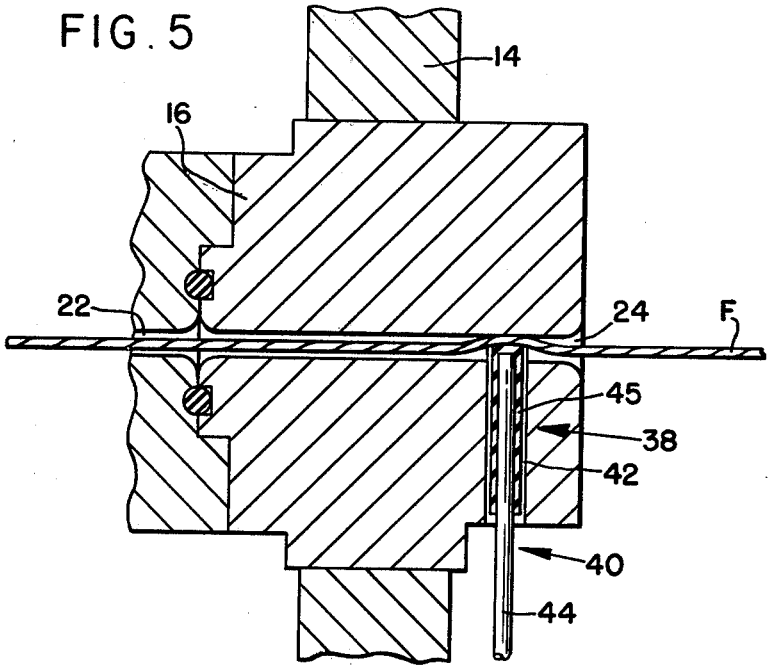
FIG. 5 is a horizontal sectional view taken on the line V—V of FIG. 4, looking in the direction of the arrows.
Figure 6:
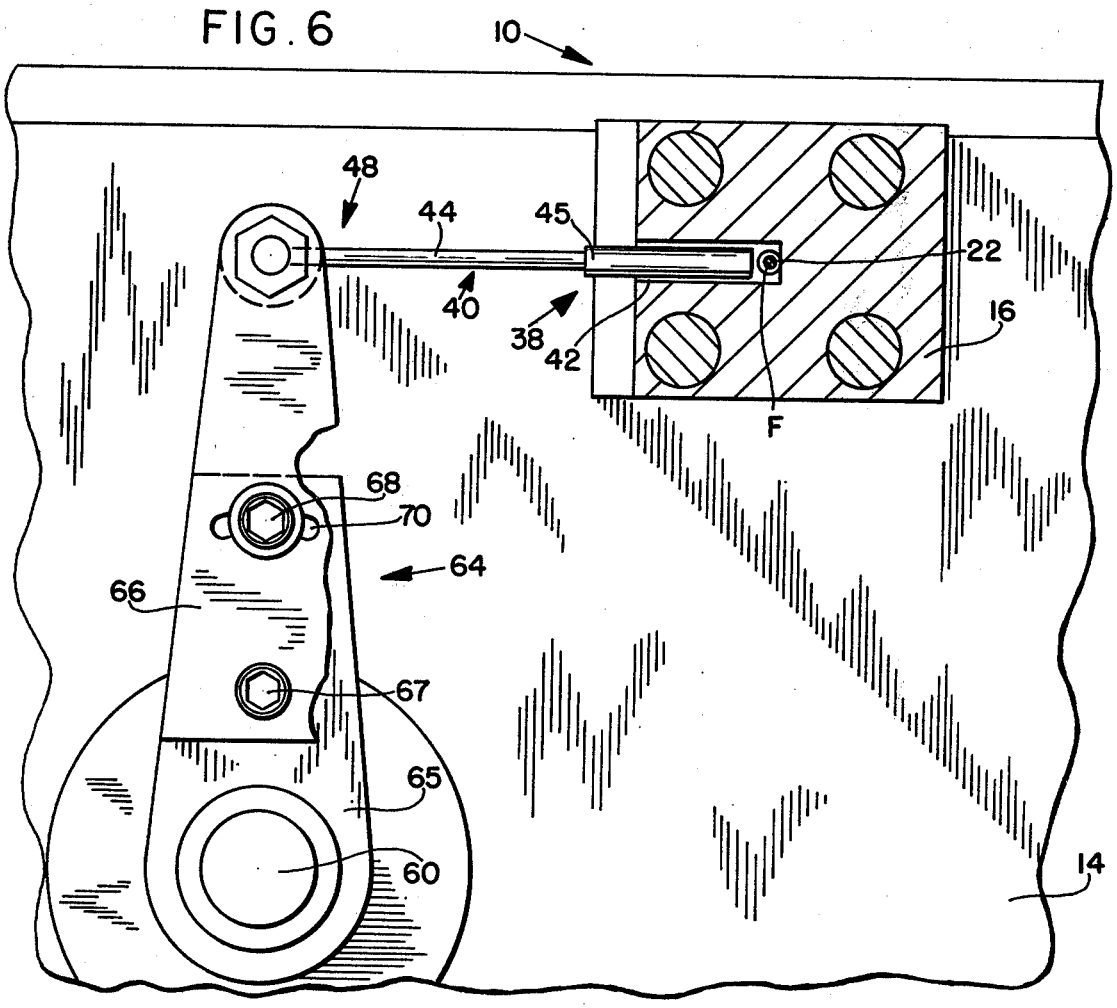
FIG. 6 is a vertical section taken on the line VI—VI of FIG. 2 on an enlarged scale.

The outer end of the projectile launching and receiving apparatus 10, adjacent outer opening 24, contains a back pressure valve generally indicated by the reference numeral 38. Referring particularly to FIGS. 5 and 6, back pressure valve 38 comprises an elongated valve element 40 slidable axially within a valve bore 42 in the housing 16. Bore 42 extends transversely to and intersects with passageway 22 and has a slightly larger diameter than the passageway. Valve element 40 comprises a rigid shank portion 44 and a resilient snubber portion 45 located at the end of valve element adjacent passageway 22. Snubber portion 45 consists of a rubber sleeve attached to the end of the shank portion 44. Valve element 40 is movable axially from an open position in which the snubber portion 45 is clear of the passageway 22, as shown in FIG. 6, to a closed position, wherein the snubber portion 45 extends into the passageway 22, as shown in FIG. 5, thereby blocking the passageway 22 and pressing the filling yarn against the far wall of the passageway.

Figure 2:
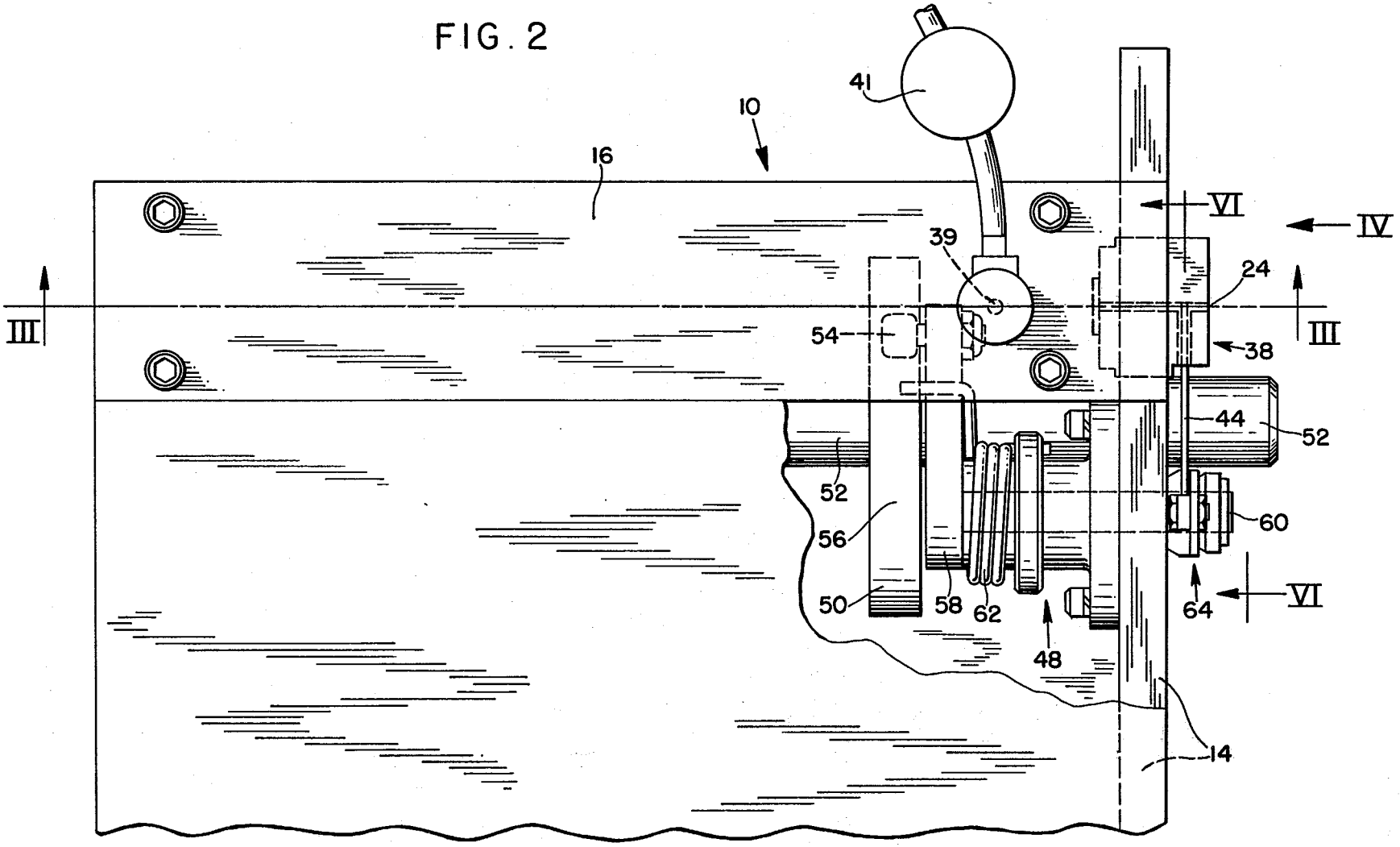
FIG. 2 is a plan view of the projectile launching and receiving apparatus of the present invention located at the right-hand side of the loom.

Valve element 40 is moved between the closed and open position by control means generally indicated by the reference numeral 48. (See particularly FIGS. 2 and 4). Control means 48 comprises a cam 50 drivingly connected to a cam shaft 52 and a follower 54 mounted for following engagement with the outer contoured surface 56 of the cam. The follower 54 is rotatably on the end of a lever 58 which is keyed to a stube shaft 60, mounted for rotation with the framework 14 and extending beyond the framework, as shown in FIG. 2. A torsion spring 62 maintains follower 54 in engagement with surface 56 of the cam. The follower 54 is operatively connected to the valve element 40 by linkage means generally indicated by the reference numeral 64 and comprises a first lever 65, keyed to stub shaft 60 and a second lever 66 mounted on the first lever 65. The shank portion 44 of valve element 40 is pivotally attached to the upper end of second lever 66, as shown in FIG. 6. The lower portion of second lever 66 is pivotally mounted on first lever 65 by means of a pivot pin 67. Lever 66 is maintained in fixed relation to lever 65 by means of a screw 68 which extends through a slot 70 at an intermediate portion of lever 66 and is threaded into the upper portion of the first lever 65. Slot 70 allows lever 66 to be angularly adjusted about pin 67 for accurate positioning of the snubber portion 45 relative to the passageway 22. Adjustments are made by loosening screw 68, moving lever 66 the desired amount, and then tightening screw 68.

Figure 4:
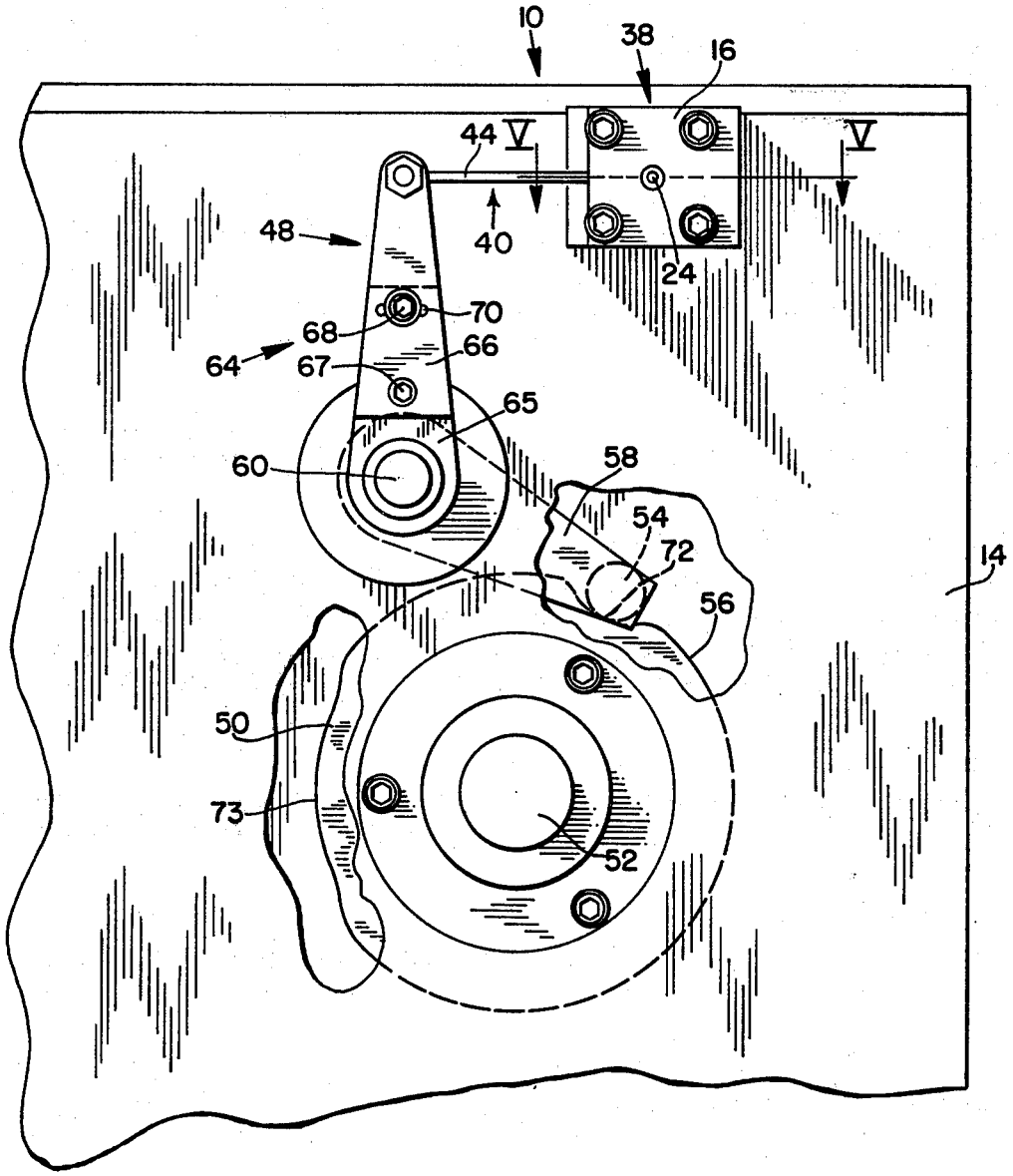
FIG. 4 is an end elevational view looking in the direction of arrow IV of FIG. 2 with portions broken away.

Cam shaft 52 is operatively connected to the main drive shaft of the loom, so that cam 50 is driven in timed relation with the usual loom functions. The main drive shaft also provides the drive force for other functions associated with the projectile launching in the receiving device 10 such as the actuation of the valves for braking and launching the projectile and for loading the projectile with filling yarn prior to launching. Cam 50 is designed so that the working surface 56 is effective to maintain follower 54 in the upper position for a major part of each revolution of the cam. When follower 54 is in its upper position, snubber portion 45 of the valve element is clear of passageway 22, as shown in FIG. 6. However, surface 56 includes low portions 72 and 73 which enable the follower 54 to drop to its low position, thereby extending snubber portion 45 into the passageway 22, as shown in FIGS. 4 and 5. Low portion 72 is associated with launching of the projectile and low portion 73 is associated with receiving of the projectile. As shown in FIG. 4, portion 72 for projectile launching is considerably shorter than portion 73 for projectile receiving.

Figure 7:
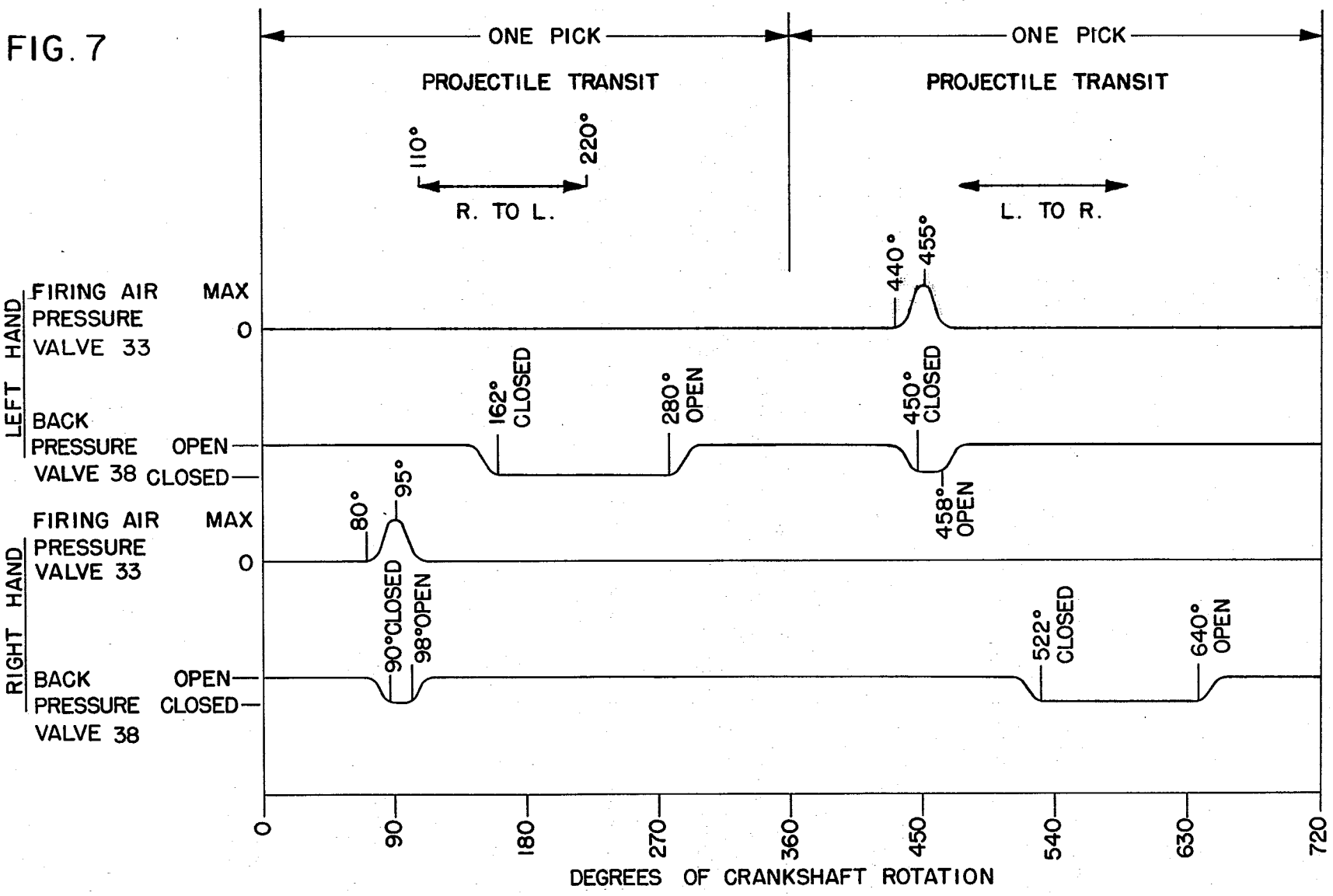
FIG. 7 is a timing diagram showing the opening and closing of the valves for launching the projectile and for closing the passageway extending from the outer opening of the projectile launching and receiving device.

FIG. 7 is a timing diagram which shows the opening and closing of valves 33 and 38 in degrees of rotation of the crank shaft or main drive shaft of the loom. The diagram extends for two rotations of the main drive shaft which also corresponds to two filling insertion cycles. The first filling insertion cycle extends from 0° to 360° and corresponds to a filling insertion from the right-hand side of the loom. The second filling insertion cycle extends from 360° to 720° and corresponds to a filling insertion from the left-hand side of the loom. The diagram shows that the right back pressure valve 38 is closed from 90° to 98° and is thereby in the closed position when the projectile is launched which is at approximately 95°. Right valve 38 is also closed from 522° to 640° when the projectile launched from the left side is received into the projectile bore 18 of the right-hand projectile launching and receiving apparatus 10. The back pressure valve 38 for the left-hand projectile launching and receiving apparatus is closed from 162° to 280° and from 450° to 458°, the former closing period corresponding to receiving of the projectile launched from the right side and the latter closing period corresponding to launching of the projectile. All of the valves are controlled by cams which are mounted on shafts which make one rotation for every two rotations of the main drive shaft of the loom. Therefore, the contour of each cam is designed to correspond to two filling insertions, one from each side of the loom. The cams associated with the left-hand side of the loom are offset from those of the right-hand side of the loom by 180° or 360° with respect to the main drive shaft or crank shaft as graphically shown in FIG. 7.

The operation and advantages of the present invention will now be readily understood in view of the above description. At the beginning of a filling insertion sequence, the projectile is positioned within the bore 18 of the projectile launching receiving device 10, so that the end 27 of tube 26 extends into the projectile. At the proper time, high pressure air is introduced into channel 29 causing a high pressure air flow in passageway 22 in the direction of the bore by means of jet 28. This air flow draws filling yarn from supply package P and introduces it into the storage chamber within the projectile by means of the tube 26. After a predetermined amount of filling has been inserted within the projectile, high pressure air flow within the passageway 22 is discontinued and a charge of high pressure air is introduced into the pressure chamber 20 through port 32. The high pressure in chamber 20 causes the projectile to be launched from bore 18 and launched through the warp shed to the opposite side of the loom to be received by a projectile launching and receiving device similar to device 10, but of opposite hand. There is a time delay between pressurization of chamber 20 and the actual launching of the projectile from bore 18, see FIG. 7. The timing of cam 50 is such that follower 54 is engaged by low portion 72 of the cam surface shortly after pressurization of chamber 20 and prior to ejection of the projectile. Therefore, snubber portion 45 of the valve element 40 is moved from its open position shown in FIG. 6, to its closed position shown in FIG. 5, just prior to launching of the projectile, thereby preventing pressurized air from creating an air flow in passageway 22 toward the outer opening 24. Snubber portion 45 enters passageway 22 just far enough to close the passageway and engages filling yarn F just enough to pinch it against the opposed wall of the passageway without damaging or breaking the yarn. As soon as the projectile is launched, valve element 40 is moved to its open position seen in FIG. 6, see also FIG. 7 for timing. After the launched projectile has reached the opposite side of the loom, the filling yarn is clamped and severed, adjacent opening 17. The severed end is retracted to a precise location within tube 26 in readiness for a subsequent filling insertion. The mechanisms for performing all of these functions are described in detail in the Wueger patent, supra.

Under certain conditions, particularly when heavy filling yarn is used, valve 31 remains open after launching of the projectile to continue the air flow in passageway 22 for drawing enough filling yarn to complete a full pick from the supply package or filling storage means and feeding it behind the projectile. The back pressure valve 38 is in the open position at this time.

After the projectile is received in the projectile launching and receiving device at the opposite side of the loom, the same procedure as described above is repeated. The projectile is launched through the warp shed from the opposite side of the loom and received into the bore 18 of the device as shown in the drawings. Before the projectile enters bore 18, pressurized air is introduced through port 34 to operate the air brakes and enable the projectile to be positioned for receiving another charge of filling yarn and for launching. As the projectile enters bore 18, follower 54 is in engagement with low portion 73 of cam 50, thereby moving valve element 40 from the open position to the closed position, so that snubber portion 45 enters passageway 22. This is effective to block the passageway and prevent an air flow in the passageway toward opening 24 which would otherwise result from a pressure buildup ahead of the projectile as it enters the bore 18. If the passageway 22 were not blocked in this manner, the air flow in the passageway caused by the incoming projectile would blow the filling yarn out of the tube 26 and possibly out of the chamber 22. Prior to reception of the projectile, the free end of the filling yarn is located within tube 26 in readiness to be inserted within the storage chamber of the projectile.

The invention having been thus described, what is claimed as new and desired to secure by Letters Patent is:

1. In a pneumatic loom in which filling picks are inserted from an outside supply source by a pneumatically launched projectile, projectile launching and receiving apparatus comprising:

(a) a housing having an inner opening at one end, an outer opening at the opposite end, a projectile receiving bore extending axially from the inner opening, a pressure chamber connected to the bore for launching the projectile and an elongated passageway extending from the outer opening to the bore for guiding filling yarn from the outer opening to the projectile receiving bore, (b) valve means including a valve element movable from an open position in which the element is clear of the passageway and a closed position in which the element is effective to seal the passageway at a point between the outer opening and pressure chamber, and (c) control means for moving the valve element to the closed position during receiving and launching of the projectile.

2. In a loom as set forth in claim 1, wherein said valve means includes a valve bore in the housing which extends at an angle to and intersects said passageway, the valve element being slidable axially within said hole.

3. In a loom as set forth in claim 1, wherein said valve element comprises an elongated rod, the longitudinal axis of which extends at an angle to the longitudinal axis of the passageway, said elongated rod being movable along its longitudinal axis toward and away from the longitudinal axis of the passageway and having an end which extends into the passageway during said closed position.

4. In a loom as set forth in claim 3, wherein said valve element comprises:

(a) a shank portion of rigid material, and (b) a snubber portion of elastomeric material mounted on the end of the shank portion for extending into said passageway.

5. In a loom as set forth in claim 4, wherein said snubber portion is a sleeve mounted on the end of said shank portion.

6. In a loom as set forth in claim 4, wherein said elastomeric material is rubber.

7. In a loom as set forth in claim 4, wherein the elongated passageway of the housing is cylindrical and the end of said snubber portion is rounded.

8. In a loom as set forth in claim 1, wherein said control means comprises:

(a) a cam driven in timed relation with the loom, (b) a follower mounted for engagement with the cam, and (c) linkage means operatively connecting the follower to the valve element.

9. In a loom as set forth in claim 8, wherein said linkage means comprises:

(a) a first lever pivotally mounted to the loom and operatively connected to the follower, (b) a second lever pivotally mounted on the first lever, and (c) adjustable means for fixing the second lever with respect to the second lever in a plurality of angular positions relative to the first lever.

* * * * *

UNITED STATES PATENT OFFICE

CERTIFICATE OF CORRECTION

PATENT NO. : 4,190,089

DATED : February 26, 1980

INVENTOR(S) : Petras Cyvas

It is certified that error appears in the above-identified patent and that said Letters Patent are hereby corrected as shown below:

Col. 4, Line 21, after "rotatably" insert "mounted".

Signed and Sealed this

*Twenty-second* Day of *July 1980*

[SEAL]

*Attest:*

SIDNEY A. DIAMOND

*Attesting Officer*

*Commissioner of Patents and Trademarks*